US006861597B2

(12) United States Patent
Baechle

(10) Patent No.: US 6,861,597 B2
(45) Date of Patent: Mar. 1, 2005

(54) SAFETY SWITCH WITH UNLATCHING DISC

(75) Inventor: Erik Baechle, Filderstadt (DE)

(73) Assignee: Euchner GmbH & Co., Leinfelden-Echterdingen (DE)

( * ) Notice: Subject to any disclaimer, the term of this patent is extended or adjusted under 35 U.S.C. 154(b) by 0 days.

(21) Appl. No.: 10/415,475

(22) PCT Filed: Feb. 8, 2002

(86) PCT No.: PCT/EP02/01334

§ 371 (c)(1),
(2), (4) Date: Apr. 30, 2003

(87) PCT Pub. No.: WO02/065496

PCT Pub. Date: Aug. 22, 2002

(65) Prior Publication Data

US 2003/0227736 A1 Dec. 11, 2003

(30) Foreign Application Priority Data

Feb. 10, 2001 (DE) ..... 101 06 228

(51) Int. Cl.[7] ..... H01H 27/00
(52) U.S. Cl. ..... 200/43.04; 200/43.07
(58) Field of Search ..... 200/42.01–43.22, 200/17 R, 18, 61.62, 333, 334

(56) References Cited

U.S. PATENT DOCUMENTS 4,695,684 A * 9/1987 Bochard et al. ..... 200/43.07
5,959,270 A * 9/1999 Wecke et al. ..... 200/43.07

FOREIGN PATENT DOCUMENTS

| | | | |
|---|---|---|---|
| DE | 3609043 | 9/1986 | |
| DE | 3943376 | 6/1991 | |
| EP | 0939415 | 9/1999 | |
| WO | WO 02065496 A * | 8/2002 | ..... H01H/27/00 |

* cited by examiner

*Primary Examiner*—James R. Scott
(74) *Attorney, Agent, or Firm*—Roylance, Abrams, Berdo & Goodman L.L.P

(57) ABSTRACT

A device switches an electrical connection in accordance with the condition of a device to be monitored, especially to a safety switch (1) for a protective device. The safety switch includes a housing (2,3) in which a switch disk (7) is mounted for rotation about an axis (8). An actuator (5) can be inserted for triggering the switching process. A latching device blocks the switch disk (7). The latching device has a latching element (12*a*, 12*b*) guided in the switch disk (7) and movable against the effect of a first energy accumulator (11). In a position in which it blocks the switch disk (7), the latching element (12*a*, 12*b*) engages an associated recess (13*a*, 13*b*) in the housing (2, 3). A rotatable release element (14*a*, 14*b*) disposed beside the switch disk (7), is rotatable relative to the switch disk (7) when the actuator (5) is inserted. When the release element (14*a*, 14*b*) is rotated, the latching element (12*a*, 12B) is slid back parallel to the axis (8) into the switch disk (7) against the effect of the first energy accumulator (11), thereby placing it in a release position.

12 Claims, 4 Drawing Sheets

SAFETY SWITCH WITH UNLATCHING DISC

FIELD OF THE INVENTION

The present invention relates to a device for switching an electric connection as a function of the state of an appliance to be monitored, in particular a safety switch for a protective appliance.

BACKGROUND OF THE INVENTION

Generic safety switches for safety appliances to be monitored, such as ones on production equipment, are disclosed in DE 43 28 296 C1.

Conventional safety switches have a housing in which a switching disk is rotatably mounted around a shaft and into which an actuator for initiating the switching process may be introduced, and have a locking mechanism for blocking the switching disk, as disclosed in EP 0 778 595 A1 (corresponding to U.S. Pat. No. 5,898,143). The locking mechanism has, in the safety switch illustrated in this patent, a locking element which may be moved against the force of an energy accumulator. In a position blocking the switching disk, the locking element may be moved into engagement with a groove on the circumferential surface of the switching disk. The locking element is contained in the housing in the process. Engagement with the switching disk takes place in a radial direction relative to the axis of rotation. In the event the application of a strong force, the danger exists that the circumferential surface of the switching disk may be damaged by the locking element.

JP 8-203 389 A discloses a safety switch in which a locking element pivotably mounted in the housing is engaged in a groove in the switching disk in the radial direction. This engagement blocks the rotary movement of the switching disk.

JP 7-260 089 A discloses a safety switch in which an elongated locking rod may be moved radially relative to the axis of rotation of the switching disk. The rotary movement of the switching disk is released when the actuator is introduced.

DE 43 38 910 C1 discloses a safety switch in which an integral release and locking element may be moved radially relative to the switching disk when the actuator is introduced. Radial movement frees the rotary movement of the switching disk.

DE 36 09 043 C2 discloses a safety switch having a switching disc rotatable in a housing, an actuator inserted in the housing to initiate the switching, and a locking mechanism. Such safety switch has a locking element contained in the switching disk and acting against the action of an energy accumulator. The locking element is engaged in an associated recess in the housing in a position blocking the switching disk. Disadvantageously, the locking element is moved directly by the actuator to be introduced, diminishing the reliability of handling.

SUMMARY OF THE INVENTION

An object of the present invention is providing a safety switch ensuring long-term handling reliability.

Another object of the present invention is providing a safety switch and the associated actuator which can be cost effectively produced.

For the present invention, these objects are attained by a locking mechanism having a rotary release element mounted next to the switching disk. The release element may be rotated relative to the switching disk and, in the process, transfers the locking element to a releasing position.

The locking element of the present invention can be movable parallel to the rotational axis of the switching disk. The release element moves the locking element backward into the switching disk into release position of the locking element against the action of a first energy accumulator.

The axis of rotation of the release element preferably coincides with the axis of the switching disk. The release element may have flanks projecting from the switching disk. The flanks act in conjunction with a corresponding crosspiece of the actuator extending generally transversely to the direction of introduction. The crosspiece of the actuator may also be U-shaped, for example, so that, in a first segment of movement during introduction, it rotates the release element only and, in an immediately following second segment of movement also engages and rotates the switching disk.

The release element in this instance preferably may be rotated relative to the switching roller against the action of a second energy accumulator. The second energy accumulator may, for example, be in the form of a torsion spring. A leg spring the first leg of the torsion spring rests against the switching disk. The second leg of the torsion spring rests against the release element.

In one particular embodiment, the release element has an opening for axial passage of the latching element. The opening extends around the axis of rotation, approximately in the shape of an arc, and has at least two areas. The edges of the areas act in conjunction with the latching element, and are spaced different radial distances from the axis of rotation. The opening is preferably offset back from the radial end of the release element, and may have an open or closed edge. The opening preferably has two associated areas with openings of different sizes. A first area having a width large enough for the latching element in the recess in the housing blocks the switching disk.

The latching element and/or the release element have/has a diagonal surface by which the rotary movement of the latching element may be reoriented to axial movement of the latching element. For this purpose, for example, the latching element may have a tapering section for operation in conjunction with the release element, so that the angle enclosed by the tapering section and the longitudinal axis of the latching element and/or the length of the tapering section, for example, may be adapted to the respective application.

The release element is preferably more or less in the form of a disk. In addition, the axis of rotation of the release element is mounted can be transverse to the direction of insertion of the actuator.

In one particular embodiment, a release element is mounted on both sides of the switching disk. Each of the release elements operates in conjunction with at least one latching element. The latching elements associated with each other on opposite sides of the switching disk preferably have a common first energy accumulator.

In one particular embodiment, the device has a switching rod on which are mounted electric contact elements guided axially in the housing and kept in contact with a circumferential surface of the switching disk. The outline of the circumferential surface determines the switching path of the switching rod. The axis of the switching disk and preferably the axis of rotation of the release element are mounted transversely to the longitudinal axis of the switching rod.

Other objects, advantages and salient features of the present invention will become apparent from the following detailed description, which, taken in conjunction with the annexed drawings, discloses a preferred embodiment of the present invention.

DETAILED DESCRIPTION OF THE INVENTION

Figure 1:
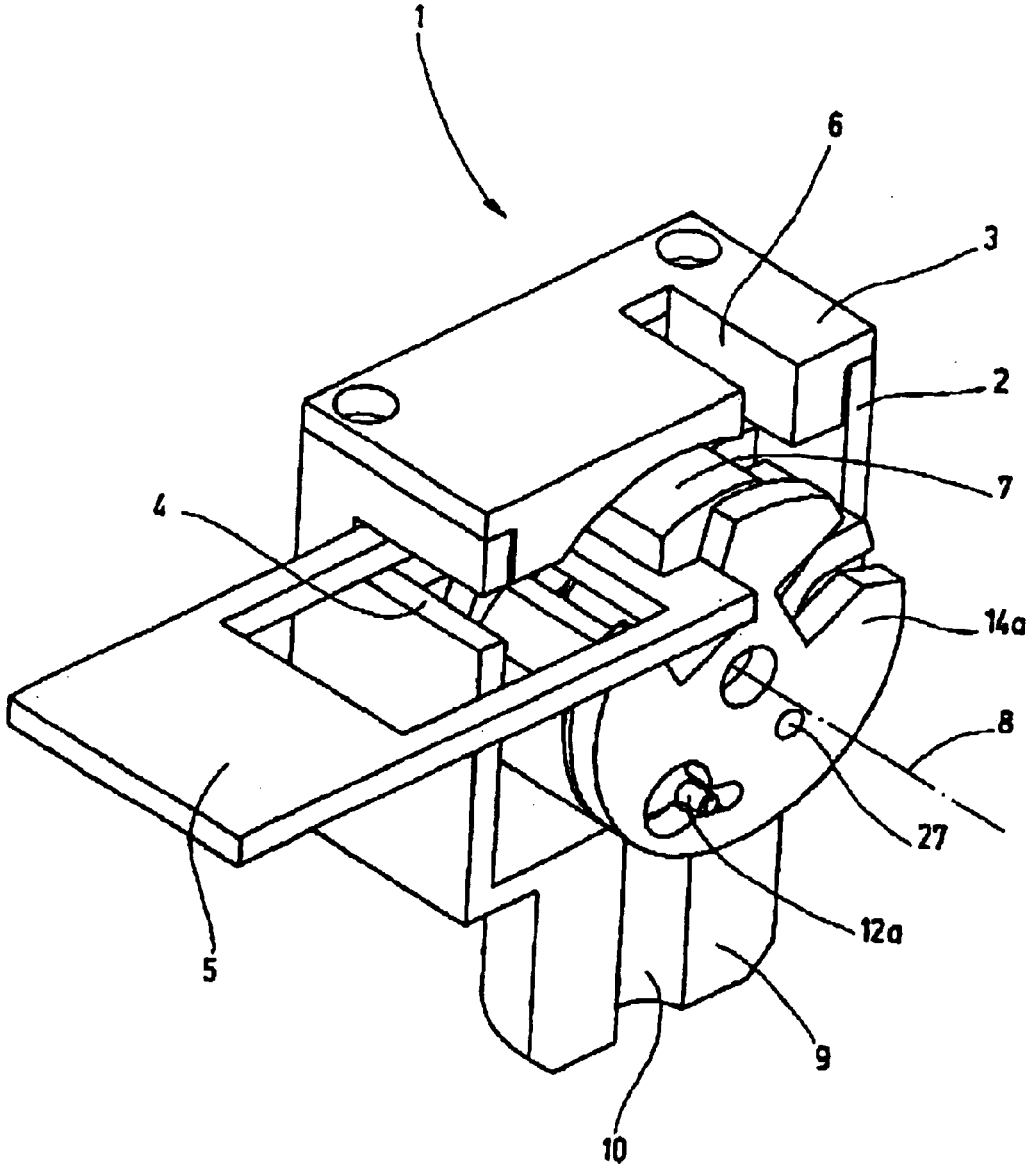
FIG. 1 is a perspective view of a safety switch according to an embodiment of the present invention.

FIG. 1 illustrates a safety switch 1 according to an embodiment of the present invention, with a housing having a housing top part 2 and a housing cover 3. Cover 3 may be slip-on mounted on the housing top part 2 and fastened to it, for example, by screws. The housing top part 2 has a first insertion slot 4 for the actuator 5. The housing cover 3 has a second insertion slot 6 for the actuator 5. The directions of insertion predetermined by the two insertion slots 4 and 6 enclose or are spaced by an angle of more or less 90°.

A switching disk 7 is mounted in the housing top part 2 for rotation about an axis 8. When the actuator 5 is inserted into at least one of the two insertion slots 4, 6 the switching disk 7 illustrated in FIG. 1 is rotated clockwise causing a switching rod 28 (not shown in FIG. 1) to be displaced axially so that an electric connection is made. The guide of the switching rod 28 and the electric contact elements are mounted in a switch housing component (not shown in FIG. 1) of the safety switch 1 and are attached to the socket 9 integral with the housing top 2. The switching rod 28 is in any event guided among other components also by the cylindrical bore 10 of the socket 9.

The safety switch 1 has a latching mechanism to block the switching disk 7. The latching mechanism has a locking or latching element 12*a* guided in the switching disk 7 and movable against the action of a first energy accumulator 11. In a position blocking the switching disk 7, latching element 12*a* is engaged in an associated recess 13*a* in the housing top part 2. For the purpose of release, the latching mechanism has a rotatable release element 14*a*. Release element 14*a* is rotatable relative to the switching disk 7 when the actuator 5 is inserted and transfers or moves the latching element 12*a* to an unblocking or release position. In particular, actuator 5 forces latch element 12*a* back into the switching disk 7 against the action or bias of a first energy accumulator 11. The unblocking position of the latching element 12*a* is illustrated in FIG. 1.

Figure 2:
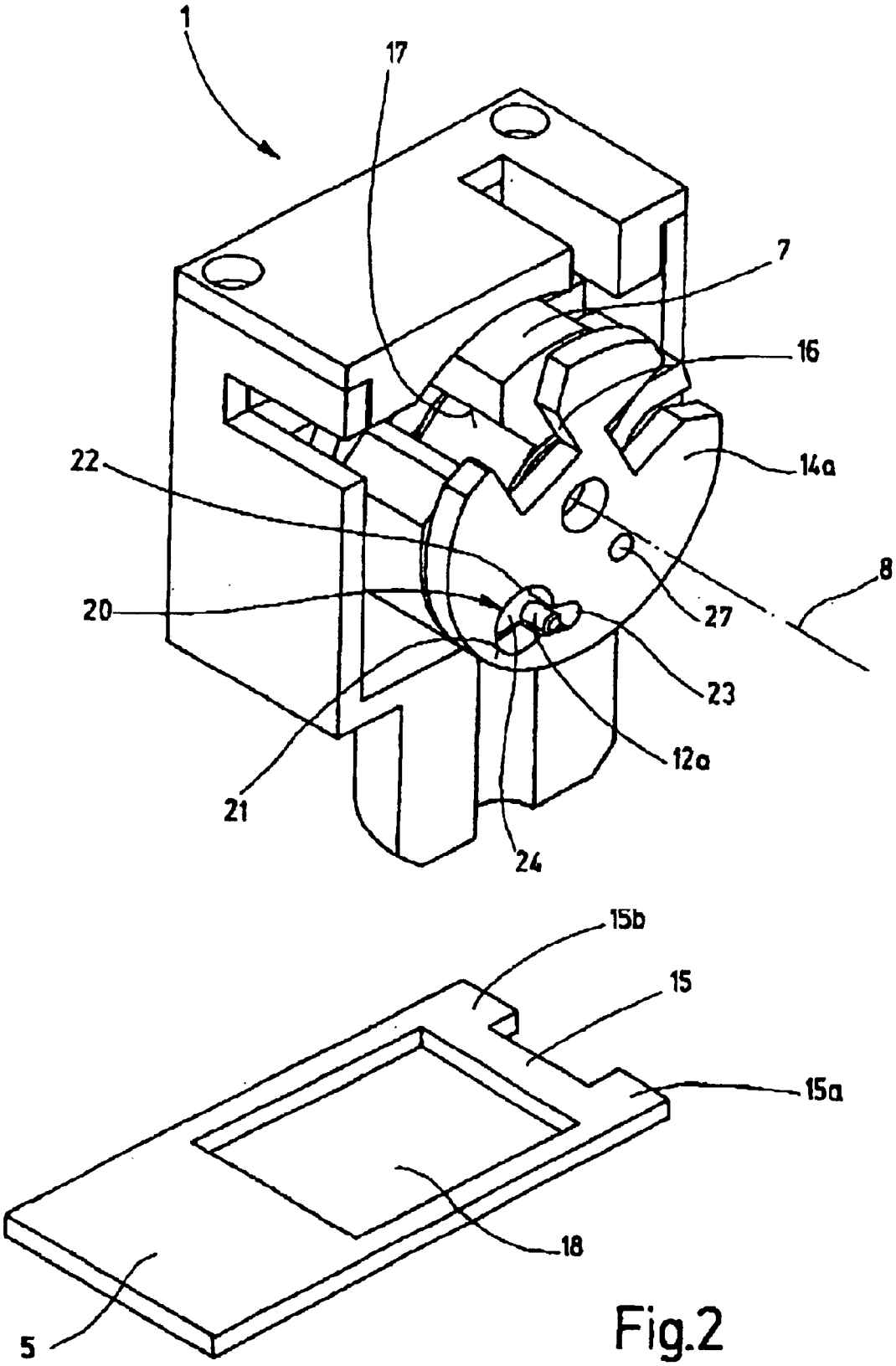
FIG. 2 is a perspective view of the safety switch of FIG. 1 with the actuator shown separately.

FIG. 2 shows the safety switch 1 in the same configuration as in FIG. 1, but with the actuator 5 shown separately. The unblocking position of the latching element 12*a* of FIG. 1 is retained. The release element 14*a* has been rotated clockwise by an angular amount of approximately 150 relative to the switching disk 7, for example, from the initial position blocking the switching disk 7. This relative rotation is achieved by the actuator 5 having, on its end facing the switching disk 7, a U-shaped crossbar 15. Crossbar 15 has, on each of its two ends, a projection 15*a*, 15*b* projecting in the direction of the switching disk 7, or respectively in the direction of the release element 14*a* or 14*b*.

In a first segment of movement during insertion of the actuator 5, the projection 15*a* engages the flank 16 formed by the release element 14*a* and, as a result of the insertion movement, rotates the release element 14*a* relative to the switching disk 7 not yet displaced in the first segment of movement. Only in a second subsequent segment of movement of actuator 5 does the central part of the crossbar 15 engage against the flank 17 of the switching disk 7 such that switching disk 7 and release element 14*a* are moved together clockwise during further insertion of the actuator.

The opening 18 in the actuator 5 is provided for passage of the switching disk 7 and the release element 14*a* when the actuator 5 is fully inserted into the safety switch 1. Both the switching disk 7 and the release element 14*a* are designed so that the safety switch 1 may be actuated with the same effect by way of both the first insertion slot 4 and the second insertion slot 6. In the process, the switching disk 7 is moved in a corresponding clockwise direction. As an alternative or in addition, the second insertion slot 6 can be provided near the edge of the housing cover 3 facing the first insertion slot 4 to rotate the curved disk 7 in both directions of rotation as a function of the insertion slot 4, 6 selected.

The release element 14*a* has an opening 20 for passage of the latching element 12*a*. The opening 20 extends more or less in the form of an arc around the axis of rotation 8 at or through an angle of approximately 45°. In the exemplary embodiment illustrated, the opening 20 is moved back or spaced radially inwardly from the radial end of the more or less disk-shaped release element 14*a* and has a closed edge 21. As an alternative to this configuration, the edge of the opening 20 may be at least partly open, and in particular may be open radially outward. A closed edge may be advantageous, for example, in the case of a plastic embodiment of the release element 14*a*, as against an open edge in the case of a metal embodiment. In addition, the edge segment of the opening 20 acting in conjunction with the latching element 12*a* may also be formed by the outline of the release element 14*a*, so that the opening is in the form of a radially incident groove suitably formed in the circumferential direction and extending in the radial direction.

The opening 20 has two associated areas openings of different sizes. A first area 22 of the opening 20 is of a width sufficient for engagement of the latching element 12*a* in the recess 13*a* in the housing blocking the switching disk 7. The subsequent second area 23 of the opening 20 is, in contrast, small enough to retain the latching element 12*a* in its unblocking position. The essential point in the exemplary embodiment illustrated is that the edge sections acting in conjunction with the latching element 12*a* of the two areas 22, 23 are spaced at different distances from the axis of rotation 8.

The latching element 12*a* and/or the release element 14*a*, the latter in particular in the area of the opening 20, have a diagonal area by means of which the rotary movement of the releasing element 14*a* may be reoriented to axial movement of the latching element 12*a*. In the exemplary embodiment illustrated, the latching element 12*a* has a tapering segment 24 which operates in conjunction with the more or less cylindrical opening 20 in the release element 14*a*.

Figure 3:
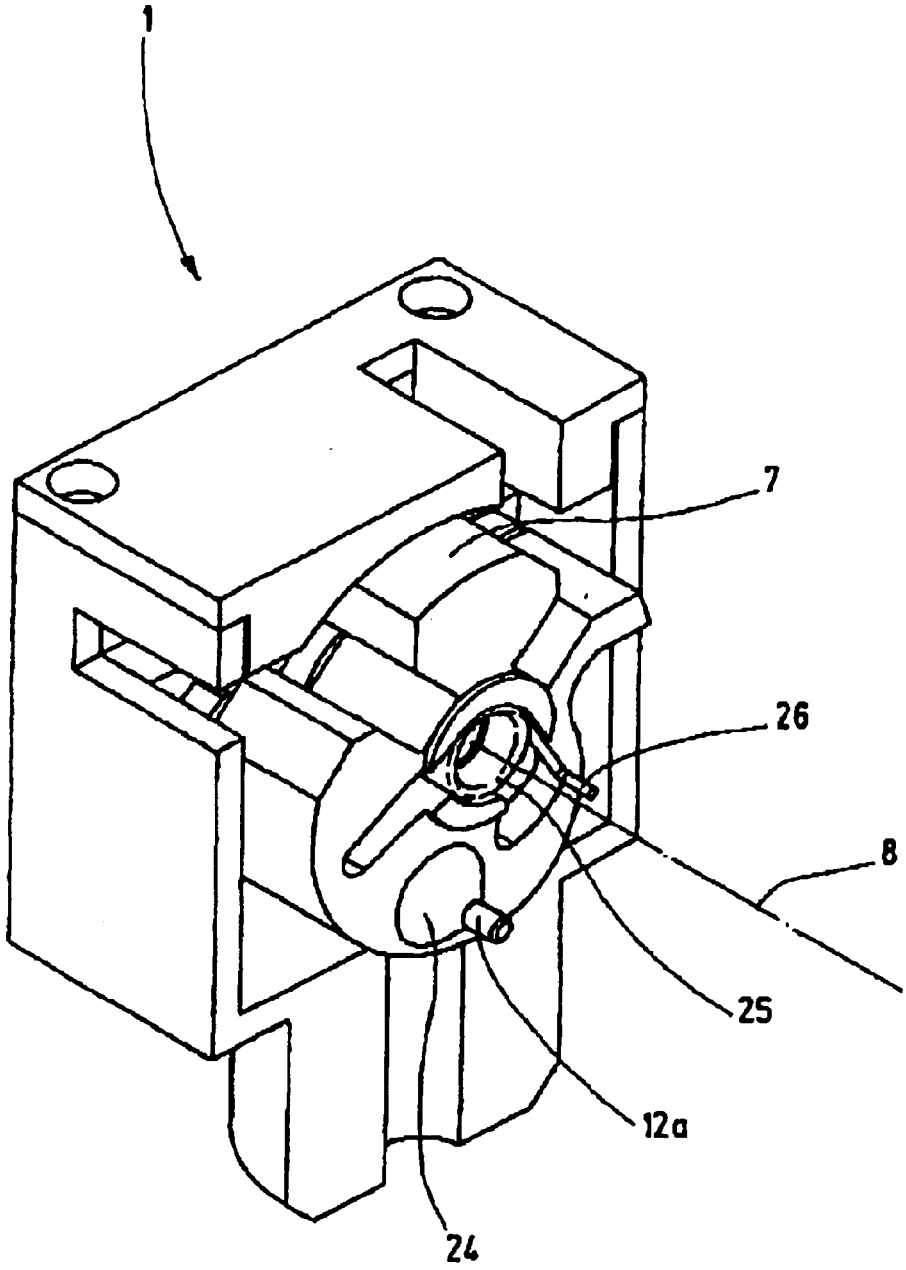
FIG. 3 is a perspective view of the safety switch of FIG. 1 with the release element removed.

FIG. 3 shows the safety switch 1 of FIG. 2 with the release element 14*a* removed. As a result, the second energy accumulator, in the form of a torsion spring 25 mounted around the axis 8, is visible. A first leg, not shown in FIG. 3, of the torsion spring 25 rests against or engages the switching disk 7. A second leg 26 of the torsion spring 25 is bent axially at its end and is engaged in a bore 27 of the release element 14*a*. The torsion spring 25 applies return force to the release element 14*a* when the actuator 5 is extracted from the safety switch 1. The latching element 12*a* has two cylindrical, in particular circularly cylindrical segments connected to each other by the tapering segment 24.

Figure 4:
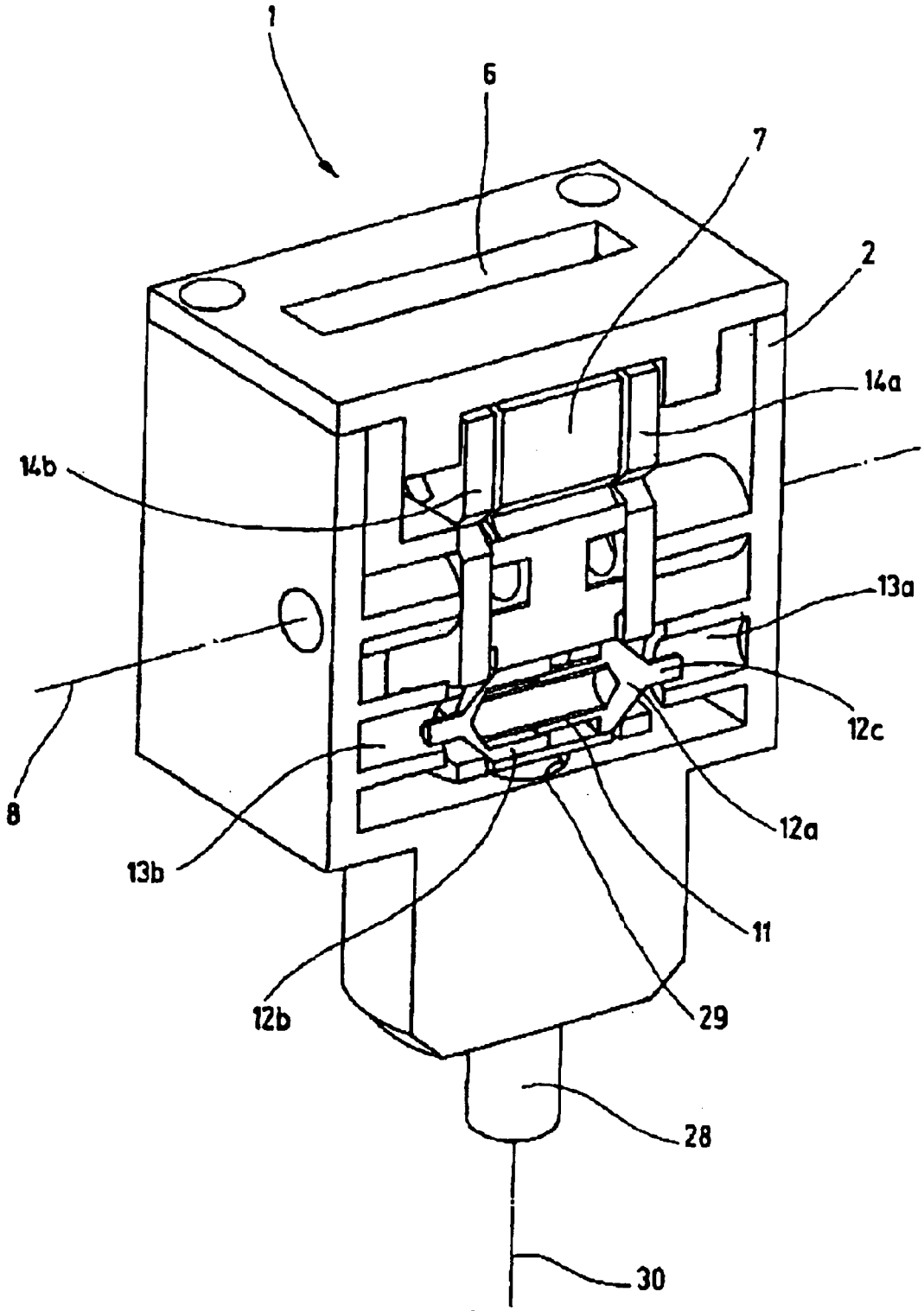
FIG. 4 is a perspective view in section of the safety switch of FIG. 1.

FIG. 4, in contrast with FIGS. 1 to 3, presents a perspective view rotated 90° of a section through the safety switch 1. The latching element 12*a* is shown in its blocking position, in which it is engaged by its cylindrical end segment 12*c* in the hollow cylindrical recess 13*a* (in the embodiment shown), which is integral with the housing top part 2. As is to be seen from this drawing, release elements 14*a*, 14*b* are mounted on the two sides of the switching disk 7. The preferably mirror symmetrical release elements 14*a*, 14*b* operate, in conjunction in each instance with at least one latching element 12*a*, 12*b*. The two latching elements 12*a*, 12*b* are identical in form on their ends facing away from each other for engagement in respective associated recess 13*a*, 13*b*. On their ends facing each other the latching elements 12*a*, 12*b* are each cylindrical, in particular hollow cylindrical, in form and are intermeshed in a telescoping fashion. A common first energy accumulator 11 is mounted inside the cavity thus formed. This accumulator-stores mechanical energy when the two latching elements 12*a*, 12*b* approach one another.

The switching rod 28, which has electric contact elements (not shown in FIG. 4) mounted on it at its end remote from the curved disk 7, is guided in the safety switch 1 so as to move axially and to be held against a circumferential surface 29. The axis 8 of the switching disk 7 and the release elements 14*a*, 14*b* extends transversely to the longitudinal axis 30 of the switching rod 28, and preferably also transversely to the predetermined directions of insertion of the actuator 5 through the insertion slots 4, 6.

While one embodiment has been chosen to illustrate the invention, it will be understood by those skilled in the art that various changes and modifications can be made therein without departing form the scope of the invention as defined in the appended claims.

What is claimed is:

1. A device for switching an electrical connection, comprising:

a housing having a housing recess;

a switching disk mounted in said housing for rotation about an axis;

an actuator insertable in said housing for initiating a switching process;

a first latching element biased by a first accumulator and guided for movement in said switching disk between a blocking position engaged in said housing recess under biasing of said first accumulator to block rotational movement of said switching disk and a release position removed from said housing recess against biasing of said first accumulator to release said switching disk to rotational movement; and first release element mounted for rotation next to said switching disk relative to said housing and said switching disk upon insertion of said actuator in said housing, rotation of said release element forcing said latching element to move to the release position in a direction parallel to said axis.

2. A device according to claim 1 wherein said release element comprises an opening for passage of said latching element.

3. A device according to claim 2 wherein said opening extends in an arc about said axis and comprises two areas with edges thereof spaced at different distances from said axis.

4. A device according to claim 2 wherein said opening is radially open.

5. A device according to claim 2 wherein said opening has a closed periphery and comprises first and second areas of different widths.

6. A device according to claim 5 wherein said first area has a width sufficient for said latching element to extend therethrough to engage in said housing recess for blocking rotation of said switching disk.

7. A device according to claim 1 wherein said latching element and said release element have diagonal areas whereby rotary movement of said release element controls axial movement of said latching element.

8. A device according to claim 7 wherein said latching element comprises a tapering segment for operating with said release element.

9. A device according to claim 1 wherein a second release element is mounted in said housing on a side of said switching disk opposite to said first release element;

said first and second release elements operate with said first latching element and a second latching element, respectively; and said first and second latching elements are associated with one another on opposite sides of said switching disk and are each biased by said first accumulator.

10. A device according to claim 1 wherein a switching rod with electric contact elements mounted thereon is mounted in said housing for axial movement and is kept in engagement with a circumferential surface of said switching disk; and said axis is transverse to a longitudinal axis of said switching rod.

11. A device according to claim 1 wherein said release element has a flank projecting from said switching disk; and said actuator has an axial projection engaging said flank before said actuator engages said switching disk.

12. A device according to claim 1 wherein a second accumulator biases said switching disk relative to said release element.

* * * * *